United States Patent [19]

Reed

[11] Patent Number: 4,679,505

[45] Date of Patent: Jul. 14, 1987

[54] 00 BUCKSHOT SHOTSHELL

[75] Inventor: Hugh B. Reed, Wayzata, Minn.

[73] Assignee: Federal Cartridge Corporation, Minneapolis, Minn.

[21] Appl. No.: 676,588

[22] Filed: Nov. 30, 1984

[51] Int. Cl.[4] ..... F42B 7/06; F42B 7/10

[52] U.S. Cl. ..... 102/449; 102/466

[58] Field of Search ..... 102/449, 454, 457, 448, 102/450, 451, 452, 453, 455, 456, 458, 459, 460

[56] References Cited

U.S. PATENT DOCUMENTS

| | | | |
|---|---|---|---|
| 17,287 | 5/1857 | Lindner | 102/431 |
| 219,491 | 9/1879 | Mason | 102/452 |
| 553,062 | 1/1896 | Follett | 102/449 |
| 1,742,817 | 1/1930 | Larson | 102/532 |
| 2,582,125 | 1/1952 | Holmes | 102/461 |
| 2,897,758 | 8/1959 | Miller et al. | 102/449 |
| 3,055,301 | 9/1962 | Miller et al. | 102/449 |
| 3,092,026 | 6/1963 | Williams et al. | 102/449 |
| 3,131,634 | 5/1964 | Freed | 102/460 |
| 3,132,589 | 5/1964 | Schafer | 102/455 |
| 3,162,124 | 12/1964 | Miller | 102/449 |
| 3,422,762 | 1/1969 | Clark, Jr. | 102/449 |
| 3,598,057 | 8/1971 | Potter | 102/449 |
| 3,786,753 | 1/1974 | Eckstein et al. | 102/449 |
| 4,479,438 | 10/1984 | Bilsbury | 102/454 |
| 4,481,885 | 11/1984 | Erickson et al. | 102/466 |

FOREIGN PATENT DOCUMENTS

| | | | |
|---|---|---|---|
| 6184 | 1/1879 | Fed. Rep. of Germany | 102/ |
| 416520 | 3/1923 | Fed. Rep. of Germany | 102/ |
| 471351 | 1/1929 | Fed. Rep. of Germany | 102/455 |
| 507888 | 9/1920 | France | 102/ |
| 1427721 | 3/1976 | United Kingdom | 102/ |

*Primary Examiner*—Deborah L. Kyle
*Assistant Examiner*—Michael J. Carone
*Attorney, Agent, or Firm*—Schroeder & Siegfried

[57] ABSTRACT

Disclosed herein is a 12-gauge 00 buckshot shotshell having a definitely improved pattern accuracy because of the manner in which the pellets are stacked within the casing prior to firing. The 00 pellets are stacked within a relatively thick-walled casing, or within a relatively thick-walled sleeve within the casing, in single pairs superimposed one upon the other, each pair nesting with its adjacent pair in a common nesting zone and none of the centers of the pellets being disposed within such a nesting zone. The casing must have an effective internal diameter of less than 2.154 times the diameter of the 00 buckshot pellets. The pellets may be stacked so that the two pellets of most of the pairs are slightly axially off-set relative to each other, and so that each pellet is arranged along one of a pair of separate varying helical paths about the axis of the casing.

22 Claims, 9 Drawing Figures

00 BUCKSHOT SHOTSHELL

DESCRIPTION

BACKGROUND OF PRIOR ART

Shotshells containing large size shot, known in the trade as buckshot, are used for hunting various large game animals and are also used for law enforcement purposes. In order for buckshot loaded shotgun shells to be more effective hunting cartridges, it is necessary that the actual buckshot pellets remain as close to one another as possible in a plane perpendicular to the aimed line of fire of the shell.

Buckshot accuracy is commonly measured in terms of a pattern at a specific yardage. The buckshot load being tested is fied at a target fixed perpendicular to the flight path of the pellets and at a predetermined distance. The resulting pattern is measured in terms of the percentage of the pellets which strike the target within a set diameter circle.

A number of techniques have been utilized in the past in an effort to elevate such percentages and shotshells encompassing such techniques are currently commercially available. They include such ideas as a protective plastic collar around the shot charge and granulated light mass pellets disposed between the buckshot pellets. Both of these features seek to reduce the deformation of the buckshot pellets, typically composed of lead or soft lead alloys, by improving their sphericity so as to develop more homologous aerodynamic characteristics between the pellets and thereby provide more uniform flight paths to the target. They do tend to provide a tighter final pattern in the plane perpendicular to the line of fire but nevertheless, there is a need for even tighter patterns to lengthen the hunting range. Hence, the need for the present invention is demonstrated.

My invention is directed to finding a basis for considerably improving the "accuracy" or pattern percentages attainable with buckshot loaded shells. Because by far the bulk of the buckshot loads which are utilized are of the 12-gauge caliber, I have confined my attention principally to that particular gauge although the principles utilized therein should also be applicable to other gauges.

Common buckshot is customarily offered in the U.S.A. in seven standard sizes, which are a function of the diameter measurement, from number 4 buckshot as the smallest through number 000 buckshot being the largest. Nominal diameters in inches are as follows:

No. 4 Buck=0.240 inches,
No. 3 Buck=0.250 inches,
No. 2 Buck=0.270 inches,
No. 1 Buck=0.300 inches,
No. 0 Buck=0.320 inches,
No. 00 Buck=0.330 inches,
No. 000 Buck=0.360 inches.

The size of buckshot most commonly utilized by hunters is the 00 size and hence, I have confined by consideration primarily to that size.

Prior to this invention, 00 buckshot within a 12-gauge shotshell were positioned in nested layer fashion with three pellets per layers. Thus, 12-gauge 00 buckshot is commonly offered in three different loadings:

2¾" 9 pellet load (3 layers of 3 pellets per layer);
2¾" 12 pellet magnum load (4 layers of 3 pellets per layer); and 3" 15 pellet magnum load (5 layers of 3 pellets per layer).

BRIEF SUMMARY OF THE INVENTION

I have discovered that by utilizing only two 00 buckshot per layer in a 12-gauge shell, while using a sleeve or shot cup having specified internal dimensions, I can substantially reduce the deformation which takes place within the buckshot and greatly increase the pattern percentage. I believe the underlying reasons for these improved results can best be understood by the following:

When a shotshell such as is shown in FIG. 1, is fired, the pellets (b) with or without a protective cup (c) are pushed through the forcing cone (a) of the shotgun barrel (f), then travel down the barrel to the choke (d) and are then free to fly to their target.

By the use of common Cartesian (x, y, axis) coordinates it is possible to describe the improved pellet orientation as well as to provide the reasoning for its improved patterning. If x is assumed to be parallel to the line of the shotgun barrel, also the longer portion of the shell, they y designates a plane perpendicular to the barrel and the shotshell.

In conventional 12 gauge 00 buckshot ammunition the 3 pellet layers all lie upon a y plane. When the shotshell (e) is fired, the buckshot pellets (b) are accelerated down the shotgun barrel (f) encountering in addition to the acceleration, large compressing radial forces along the y plane both at the forcing cone (a) and at the choke at the end of the barrel (f).

When you utilize only two 00 buckshot per layer, you reduce the number of pellet to pellet contact points, especially those parallel with the y plane. It is at these contact points that the pellets become distorted during the pellets' passage and acceleration through the firing cone and choke. Such distortion leads to less aerodynamically uniform pellets which in turn leads to lower pattern percentages. I utilize a thick-walled shot-cup or a casing with unusually thick sidewalls to reduce the internal diameter so as to prevent more than two pellets being disposed in a single layer. When a casing, sleeve, or shot-cup having an internal diameter less than 2.154 times the diameter of a 00 buckshot is used, the pellets are disposed in pairs in transverse layers, although sometimes not directly opposite each other, and are aligned along a pair of varying helical paths. I find that substantially improved pattern percentages are thereby produced.

DETAILED DESCRIPTION OF INVENTION

Figure 1:
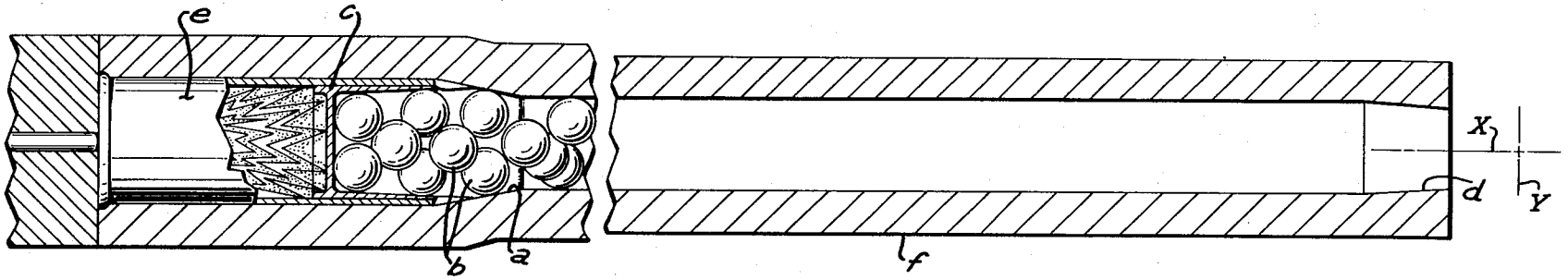
FIG. 1 is a diagrammatic vertical sectional view taken through a gun barrel with a shotshell having a buckshot load therein to illustrate the forces applied to the pellets upon firing.

FIG. 1, as hereinbefore described, diagramatically illustrates a gun barrel (f) with a 00 lead buckshot shotshell (e) shown therein in partial section. Upon firing, compressive forces are applied to the pellets (b) by the forcing cone (a) as they leave the shotcup (c). Additional radial compressive forces are applied to the pellets as they pass outwardly through the choke (d). It is these radial compressive forces which cause the pellets to flatten at their contact or load-bearing points, particularly when the pellets are directly opposite each other in the transverse (y) plane. When such pellets are directly opposite each other within the y plane and in contact with each other and also with the inner surface of the barrel (f), the contact or load-bearing points flatten and as a direct consequence, the pattern results of the shotshell are affected adversely. This is what takes place in the conventional 12 gauge shotshell having layers of three 00 lead buckshot in the transverse (y) axis, providing poorer patterns than necessary.

I have discovered that by stacking the 00 lead buckshots so as to reduce the number of contact or load-bearing points, and preferably so as not to be directly opposite each other in the transverse (y) plane, the number and extent of flattened areas at such points is substantially reduced and, hence, the resultant pattern is substantially improved. Our tests show that the patterns are improved by at least 23% and at times by as much as 80%. It appears that the extent of flattening at such points is minimized when all or most of the pellets are axially off-set relative to each other so as not to be positioned directly oppositely along the y axis of the barrel. It is believed that this is a consequence, in part at least, of the ability of the pellet charge to elongate relative to the barrel instead of being trapped within a transverse (y) plane by the inner walls of the barrel.

Figure 2:
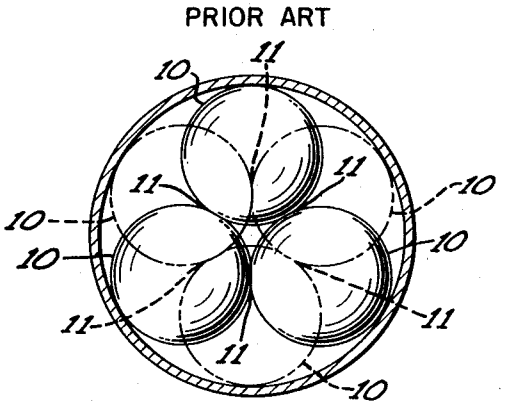
FIG. 2 is a horizontal sectional view of a shotshell loaded with 00 load buckshot in the conventional manner as heretofore known, with the inner diameter of the casing being 2.154 times the diameter of an 00 lead buckshot or slightly larger and showing the stacking arrangement of the pellets in layers of three.

FIG. 2 illustrates the position of 00 lead buckshot pellets 10 in a conventional 12 gauge 00 buckshot shotshell as offered today in the market. It will be seen that the pellets 10 are arranged in transverse layers of three, each in contact with the other. As shown, the lower of the two layers illustrated are displayed in solid line while the pellets of the next layer superimposed directly thereabove and in contact therewith, are indicated with broken lines. It will be readily seen that each of the pellets of each of the transverse layers is in contact with two of the pellets of each of the layers immediately therebelow and thereabove. In addition, each pellet is in contact with the other two pellets in the same transverse (y) plane at contact or load-bearing points indicated by the numeral 11. Thus, each such pellet 10 within the interior of the stack has a minimum of six (6) contact or load-bearing points with its adjacent pellets. It is at these points at which the sphericity-damaging flattening takes place upon firing of the shotshell, and the more of these points which exist and flatten, the poorer is the pattern which the pellets will provide. Only the pellets of the inner layer (that adjacent the propellant) and of the outer layer have less than six such load-bearing points.

Figure 3:
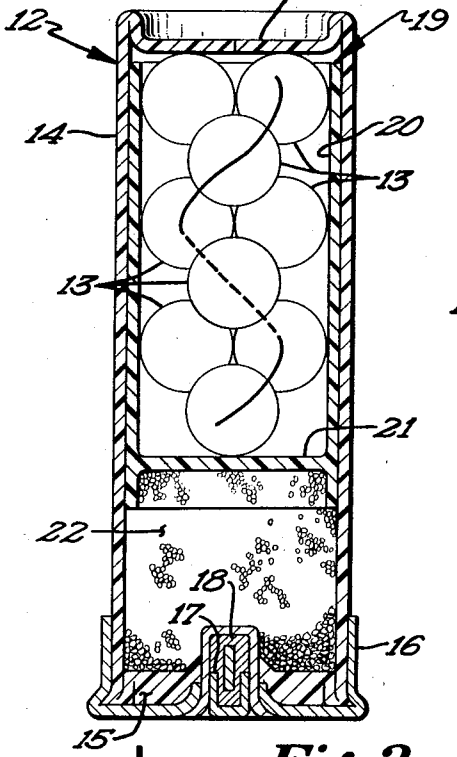
FIG. 3 is a side vertical sectional view of a shotshell loaded in accordance with my invention and with the inner diameter of the shot-cup being 2.000 times the diameter of an 00 lead buckshot pellet and showing stacking arrangements of pellets under my invention.
Figure 4:
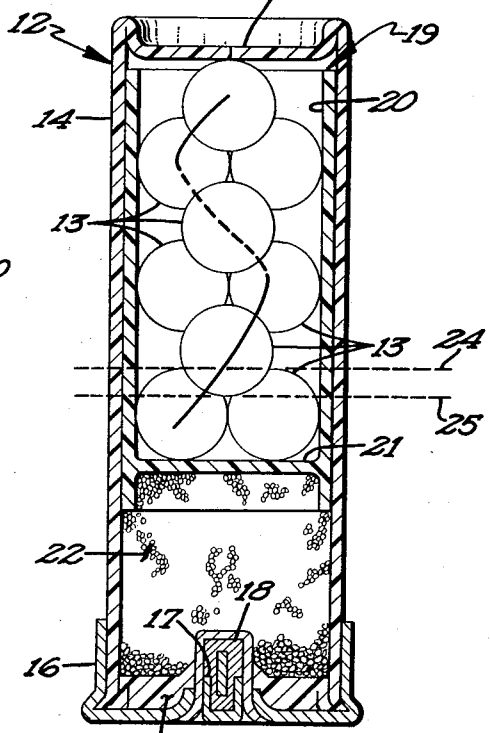
FIG. 4 is a vertical sectional view of the shell shown in FIG. 3, taken at 90° thereto and showing the stacking arrangement of the pellets as viewed from that angle.

FIGS. 3 and 4 show, in section, a plastic 12 gauge shotshell casing 12 loaded with 00 lead buckshot pellets 13 stacked in one of the improved but not the preferred, arrangements of my invention. As shown, the tubular walls 14 are integral with the base wad 15 to which is applied a conventional metal cap or head 16. The base wad 15 is 0.090 inch thick, is biaxially oriented, and is provided with a conventional central primer opening 17 which accomodates a conventional primer 18.

Figures 5, 6, 7, 8, 9:
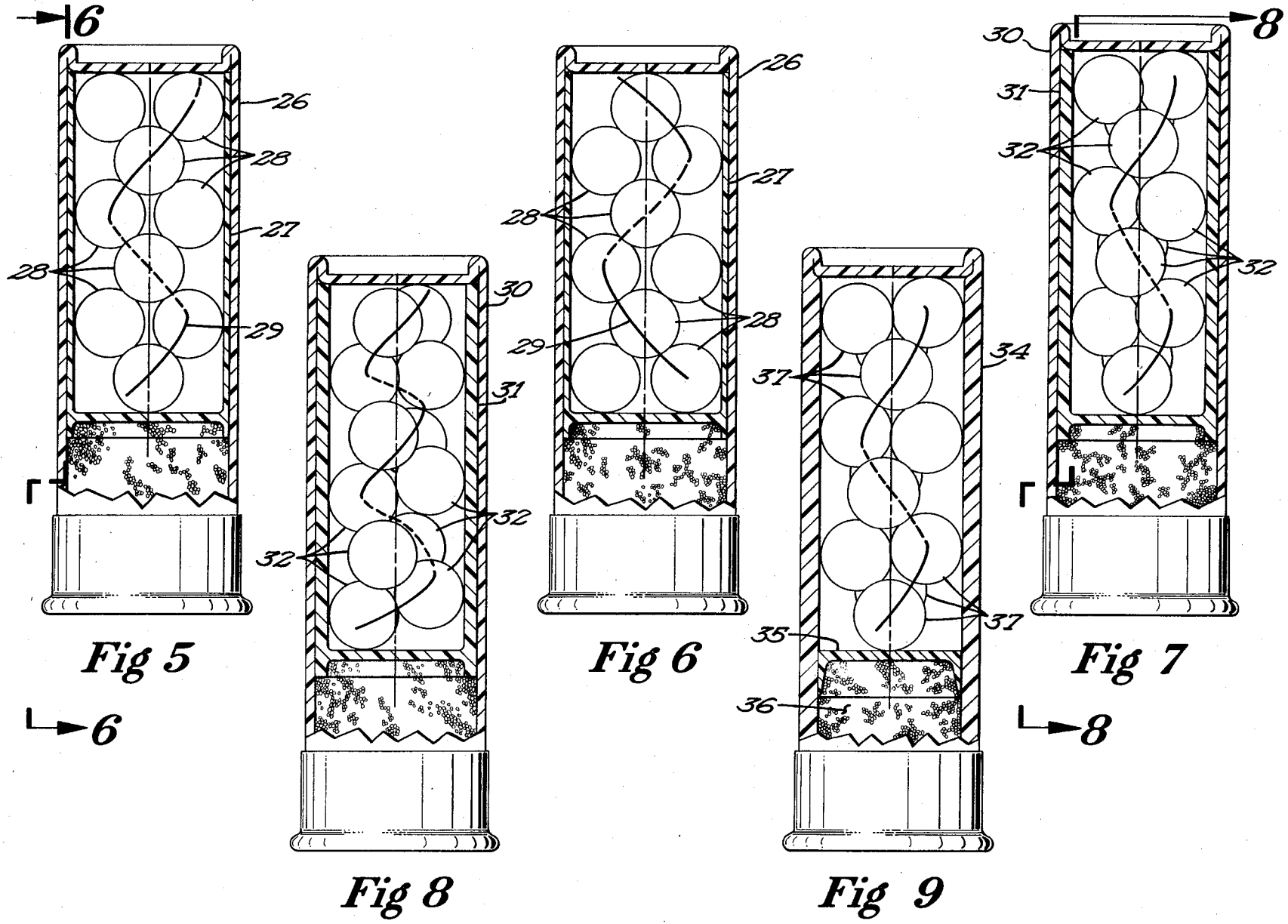
FIG. 5 is a vertical sectional view of a shotshell loaded in accordance with my invention with the inner diameter of the shot-cup being greater than 2.000 and less than 2.154 times the diameter of an 00 lead buckshot pellet and showing the stacking arrangement of the pellets.
FIG. 6 is a vertical sectional view of the shell shown in FIG. 5, taken at 90° thereto and showing the stacking arrangement of the pellets as viewed from that angle.
FIG. 7 is a vertical sectional view of a shotshell loaded in accordance with my invention with the inner diameter of the shot-cup being less than 2.000 times the diameter of an 00 lead buckshot pellet and showing the stacking arrangement of the pellets.
FIG. 8 is a vertical sectional view of the shell shown in FIG. 7 taken at 90° thereto and showing the stacking arrangement of the pellets as viewed from that angle.
FIG. 9 is a vertical sectional view of a shotshell loaded in accordance with my invention with the inner diameter of the relatively thick casing being less than 2.154 times the diameter of an 00 lead buckshot and showing the stacking arrangement of the pellets.

The effective internal diameter of the casing 12 is the internal diameter of the plastic shot cup 19 which is comprised of a plastic sleeve 20 which may be formed integrally with a plastic obturator member 21 which covers the propellant 22. The sleeve 20 has abnormally thick walls so that the internal diameter thereof, and hence the effective internal diameter of the casing in this instance, is exactly two times the diameter of a 00 lead buckshot pellet. It will be readily appreciated that, as illustrated by FIG. 9, the same effect can be obtained by eliminating the sleeve 20 and making the tubular walls 14 as thick as the combined thickness of the sleeve 20 and walls 14. In either event, the same effective internal diameter of the casing is obtained. The shot cup 19 is provided to protect the inner surfaces of the barrel and pellets 13, as is frequently the case in conventional shotshells.

In addition, the pellets 13 may be coated with a hardened surface such as antimony or copper, and a granulated material may be disposed between the pellets as has become conventional in shotshells as hereinbefore described. Since such granulated material is not a part of the invention, I have omitted showing such coatings and the granulated material in each of the views of FIGS. 3–9 in order to avoid undue complexity in the drawings.

Since the effective internal diameter of the casing 12 is exactly two times the nominal diameter of the pellets 13, they will be arranged as shown in FIGS. 3 and 4, if hand loaded. As a practical matter, in machine manufacture of such shotshells, not all of the pellets will fall exactly into place in opposite pairs, as shown in FIG. 3 and 4 and in that event, the number of contact or load-bearing points will be reduced and an improved pattern will result. As shown in FIGS. 3 and 4, however, each pellet within the interior of the stack will have five such load-bearing points, two with the pair immediately below, two with the pair immediately above, and one with the other opposite pellet which lies within the same transverse (y) plane. The pellets inner and outer pairs will each have only three such contact or load-bearing points. In the instance where pellets do not fall into directly opposite positions in the same (y) plane, such pellets will have only four such load-bearing points.

Thus it will be seen that when the effective internal diameter of the casing 12 is exactly two times the nominal diameter of a 00 lead buckshot pellet, a reduction in the number of load-bearing points will be accomplished. Since the number of such points will be reduced from six (6) to either four (4) or five (5), the resulting pattern is definitely improved, although not to the maximum extent possible, as will be seen hereinafter.

As shown in FIGS. 3 and 4, the outer end portion of the tubular walls 14 of the casing 12 are utilized as a closure means 23 to hold the pellets 13 in their stacked positions until the shotshell is fired, as has become conventional in the manufacture of shotshells.

As can be seen by reference to FIG. 4, the pellets 13 when so stacked are arranged along a helical path which extends around the axis of the casing 12. When the pellets do not position exactly opposite each other, they are arranged along a varying helical path.

As can also be seen by reference to FIGS. 3 and 4, each pellet 13 or pair of pellets 13 intersect a nesting zone with its adjacent pellet 13 or pair of pellets 13, and their centers lie outside that zone. Thus the bottom pair of pellets 13, as viewed in FIG. 4, nests with the pair immediately thereabove in a nesting zone area defined between the two dotted lines 24 and 25. Their centers are obviously disposed exteriorly of that area.

FIG. 5 and FIG. 6 show a 12 gauge shotshell constructed in the same manner as that shown in FIGS. 3–4, but differing in that the effective internal diameter of the casing 26 (the internal diameter of the shot cup 27) is greater than 2.000 times the nominal diameter of 00 lead buckshot and less than 2.154 times the diameter thereof. If its internal diameter were greater than 2.154 times the diameter of 00 lead buckshot, then the latter would settle into layers of three. Thus it is imperative that the effective internal diameter of the casing be no greater than 2.154 times the diameter of 00 lead buckshot to preclude the formation of layers of three pellets.

Since the effective internal diameter of the casing 26 is greater than 2.000 times the diameter of 00 lead buckshot, the pellets 28 of each pair are spaced from each other and lie in the same transverse (y) plane. They also extend into nesting zones similar to those described with respect to FIGS. 3–4, with the pellets in their immediately adjacent planes, and their centers are disposed exteriorly of said zones. In addition, they are arranged along varying helical paths about the axis of the casing 26, as illustrated by the broken lines 29.

Because the pellets of each transverse pair of FIGS. 5–6 do not touch each other in casings having effective internal diameters within the range of 2.001–2.154 times the nominal diameter of 00 lead buckshot, the maximum number of load-bearing points of the pellets within each such casing is four. The inner and outermost pairs, of course, have only two such load-bearing points. As a consequence, a shotshell loaded in a casing having an effective internal diameter as defined herein for FIGS. 5–6, will produce a better pattern than one having its pellets arranged as shown in FIGS. 3–4.

The preferred form of my invention is shown in FIGS. 7–8. The shotshell shown in FIGS. 7–8 is constructed in the same manner as those shown in FIGS. 3–6, inclusive except that the effective internal diameter of the casing 30 (the internal diameter of the shot cup 31) is less than 2.000 times the nominal diameter of 00 lead buckshot. It can be readily seen that the tubular walls of the sleeve of the shotcup 31 are substantially thicker than the sleeves shown in FIGS. 3–6, inclusive. As a consequence thereof, the effective internal diameter of the casing 30 is less than 2.000 times the diameter of 00 lead buckshot and it is impossible for any two of the pellets 32 to become arranged directly opposite each other in the same transverse (y) plane. Moreover the number of load-bearing contact points of each pellet with another is reduced to a maximum of three. In view thereof, there are a substantial lesser number and extent of flattened areas as compared to those experienced in loads having transverse layers of three pellets each. Our tests show a substantial improvement of 23–80% in the pattern produced through the stacking arrangement described hereinabove.

The pellets 32 arrange themselves along a pair of separate varying helical paths when stacked as shown and described in FIGS. 7–8. They also intersect a separate nesting zone with their adjacent pellets in the same manner as described with respect to FIGS. 3–4, and their centers lie outside such nesting zones.

Each of the shotshells shown in FIGS. 3–8, inclusive, and described hereinabove are 12 gauge shotshells, as is that shown in FIG. 9. The latter figure illustrates how the same benefits as that described hereinabove can be obtained without a sleeve disposed within the casing. As shown, the sleeve is omitted and the walls of the casing 34 may be made as thick as the combined casing and sleeve dimensions shown in the earlier figures to obtain the same results. Otherwise the casing 34 is constructed in the same manner as shown in FIGS. 3–4 and a conventional obturator element 35 covers the propellant 36 and separates the latter from the 00 lead buckshot pellets 37.

The interior dimensions of the casing 34 are the same as the effective internal diameter of the casing 30 of FIGS. 7 and 8 and hence the pellets 37 are arranged the same as pellets 32 of FIG. 7. They have the same nesting zones and are arranged along the same varying helical paths. They also have a maximum of three load-bearing contact points and provide the same pattern benefits for the same reasons.

Since the loads shown and described with respect to FIGS. 7–9 have pellets with a maximum of only three load-bearing contact points, the patterns of such loads show marked improvement over those heretofore known. When the effective internal diameter of the casings are only slightly less than 2.000 times the diameter of 00 lead buckshot, the pellets are arranged essentially in pairs, the individual pellets of which are close to being in the same transverse plane, but are slightly axially off-set relative to the axis of the casing.

Of course if the internal dimensions of such a casing were to be reduced to an effective diameter approaching the diameter of a 00 lead buckshot pellet, then each pellet would have only two such load-bearing contact points and the resultant pattern produced would be even more highly improved. Such an arrangement would, of course, necessitate a longer shotshell to accomodate the normally desired number of pellets for each load.

In considering this invention, it should be remembered that the present disclosure is illustrative only and the scope of the invention should be determined by the appended claims.

What is claimed is:

1. A 12 Gauge 00 lead buckshot shotshell comprising:
(a) a shotshell casing having elongated tubular sidewalls and having a basewad with a centrally disposed primer opening extending therethrough longitudinally of said casing;
(b) a shotshell primer disposed within said primer opening;
(c) a propellant superimposed with respect to said primer within said casing;
(d) obturator wad means superimposed upon and covering said propellant;
(e) a sleeve member disposed within said casing in superimposed relation to said wad means and having a constant internal diameter greater than 00 buckshot but less than 2.154 times the diameter of 00 lead buckshot;
(f) a plurality of 00 lead buckshot pellets superimposed upon each other within the sleeve member, each of said pellets intersecting a nesting zone with an adjacent pellet and having load-bearing points of contact relative to the adjacent pellets the total of which numbers greater than zero but less than six;
(g) closure means closing the end of said casing and holding said buckshot within said casing until the shotshell is fired; and
(h) the center of each of said pellets being located outside the nesting zones of said pellet 2. The structure defined in claim 1 wherein each of said pellets has points of contact with other of said pellets numbering greater than zero but less than five.

3. The structure defined in claim 1 wherein each of said pellets has points of contact with other of said pellets numbering greater than zero but less than four.

4. The structure defined in claim 1 wherein each of said pellets has points of contact with other of said pellets numbering greater than zero but less than three.

5. The structure defined in claim 1, wherein the center of each said pellet is located in a separate transverse plane normal to the longitudinal axis of said shotshell casing.

6. The structure defined in claim 1, wherin said pellets generally form a pair of varying helical paths about the axis of said casing.

7. A 12 Gauge 00 lead buckshot comprising:
(a) a plastic shotshell casing having elongated tubular sidewalls and having a basewad with a centrally disposed primer opening extending therethrough longitudinally of the casing;
(b) a shotshell primer disposed within said primer opening;
(c) a propellant superimposed with respect to said primer within said casing;
(d) obturator wad means superimposed upon and covering said propellant;
(e) a sleeve member disposed within said casing in superimposed relation to said wad means and having a constant internal diameter greater than 00 buckshot but less than 2.0 times the diameter of 00 lead buckshot;
(f) a plurality of 00 buckshot pellets superimposed upon each other within said sleeve member, each of said pellets intersecting a nesting zone with and contacting at least one adjacent pellet, the center of each of said pellets being located outside the nesting zones of said pellet; and
(g) closure means closing the end of said casing and holding said buckshot within said casing until the shotshell is fired.

8. The structure defined in claim 7, wherein said pellets generally form a pair of varying helical paths about the axis of said casing.

9. A 12 Gauge 00 lead buckshot shotshell comprising:
(a) a plastic shotshell casing having elongated tubular sidewalls and having a basewad with a centrally disposed primer opening extending therethrough longitudinally of the casing;
(b) a shotshell primer disposed within said primer opening;
(c) a propellant superimposed with respect to said primer within said casing;
(d) obturator wad means superimposed upon and covering said propellant;
(e) a sleeve member disposed within said casing in superimposed relation to said wad means and having a constant internal diameter greater than 00 buckshot but less than 2.0 times the diameter of 00 lead buckshot;
(f) a plurality of single pairs of 00 lead buckshot pellets superimposed upon and in contact with each other within said sleeve member, the major portion of each of which extends in a common transverse plane relative to said casing, each of said pairs intersecting a transverse nesting zone with each adjacent single pair of said pellets;
(g) closure means closing the end of said casing and holding said buckshot in said layers within said casing until the shotshell is fired; and
(h) the center of each of said pellets being located outside the nesting zones of said pellet and radially outward relative to the longitudinal axis of said casing.

10. A 12 Gauge 00 lead buckshot shotshell comprising:
(a) A plastic shotshell casing having elongated tubular sidewalls and having a basewad with a centrally disposed primer opening extending therethrough longitudinally of the casing;
(b) a shotshell primer disposed within said primer opening;
(c) a propellant superimposed with respect to said primer within said casing;
(d) obturator wad means superimposed upon and covering said propellant;
(e) a sleeve member disposed within said casing in superimposed relation to said wad means and having a constant internal diameter of less than 2.154 times the diameter of 00 lead buckshot;
(f) a plurality of single pairs of 00 lead buckshot pellets superimposed upon and in contact with each other within said sleeve member, the major portion of each of which extends in a common transverse plane relative to the axis of said casing each of said pairs intersecting a transverse nesting zone with each adjacent single pair of said pellets, each of said pellets having points of contact, the total of which numbers no more than five, with other of said pellets;
(g) closure means closing the end of said casing and holding said buckshot within said casing until the shotshell is fired; and
(h) the center of each of said pellets being located outside the nesting zones of said pellets and some of said pellets resting in independent transverse planes normal to the axis of said casing.

11. The structure defined in claim 10 wherein at least some of said pellets having points of contact with other of said pellets numbering no more than four.

12. A 12 Gauge 00 lead buckshot shotshell comprising:

(a) a plastic shotshell casing having elongated tubular sidewalls and having a basewad with a centrally disposed primer opening extending therethrough longitudinally of the casing;

(b) a shotshell primer disposed within said primer opening;

(c) a propellant superimposed with respect to said primer within said casing;

(d) obturator wad means superimposed upon and covering said propellant;

(e) a sleeve member disposed within said casing in superimposed relation to said wad means and having a constant internal diameter within the range of 2.000 and 2.154 times the diameter of 00 lead buckshot;

(f) a plurality of single pairs of 00 lead buckshot pellets superimposed upon each other within said sleeve member, each of said pairs intersecting a transverse nesting zone with each adjacent single pair of said pellets and contacting the same, said pellets being arranged along a pair of separate generally helical paths about the axis of said casing;

(g) closure means closing the end of said casing and holding said buckshot in said layers within said casing until the shotshell is fired; and (h) the center of each of said pellets being located outside the nesting zones of said pellet.

13. The structure defined in claim 12 wherein some of said pellets have their centers in the same transverse plane normal to the axis of said casing.

14. The structure defined in claim 12, wherein each of said pairs of pellets is comprised of two pellets, most of said two pellets comprising said pairs of pellets being offset to each other in a direction parallel to the axis of said casing.

15. The structure defined in claim 12, wherein each of said pairs of pellets is comprised of two pellets which, except for the two pellets comprising the innermost pair of pellets adjacent said obturator wad means, are offset in a direction parallel to the axis of said casing.

16. A 12 Gauge 00 lead buckshot shotshell comprising:

(a) a shotshell casing having elongated tubular sidewalls and having a basewad with a centrally disposed primer opening extending therethrough longitudinally greater than but said casing, said casing having a constant effective internal diameter of less than 2.154 times the diameter of 00 lead buckshot;

(b) a shotshell primer disposed within said primer opening;

(c) a propellant superimposed with respect to said primer within said casing;

(d) obturator wad means superimposed upon and covering said propellant;

(e) a plurality of 00 lead buckshot pellets superimposed upon each other within said casing, each of said pellets intersecting a nesting zone with an adjacent pellet and having load-bearing points of contact relative to its adjacent pellets the total of which numbers greater than zero but less than six;

(f) closure means closing the end of said casing and holding said buckshot within said casing until the shotshell is fired; and (g) the center of each of said pellets being located outside the nesting zones of said pellet and in a separate transverse plane normal to the axis of said casing.

17. A 12 Gauge 00 lead buckshot shotshell comprising:

(a) a plastic shotshell casing having elongated tubular sidewalls and having a basewad with a centrally disposed primer opening extending therethrough longitudinally of the casing;

(b) a shotshell primer disposed within said primer opening;

(c) a propellant superimposed with respect to said primer within said casing;

(d) obturator wad means superimposed upon said propellant;

(e) a sleeve member of constant diameter and substantially uniform wall thickness throughout disposed within said casing in superimposed relation to said wad means;

(f) a plurality of single pairs of 00 lead buckshot pellets vertically stacked upon each other within said sleeve member, each of said pairs being disposed in a transverse nesting zone with each adjacent single pairs, each pellet of each of said pairs being disposed with and contacting at least one of the pellets of each of the other of said pairs of pellets along a varying generally helical path about the axis of said casing;

(g) closure means closing the end of said casing and holding said buckshot in said layers within said casing until the shotshell is fired; and (h) the center of each of said pellets being located outside the nesting zones of said pellet and offset relative to all other said pellets in a direction parallel to the axis of said casing.

18. A 12 Gauge 00 lead buckshot shotshell comprising:

(a) a plastic shotshell casing having elongated tubular sidewalls and having a thin basewad with a centrally disposed primer opening extending therethrough longitudinally of the casing;

(b) a shotshell primer disposed within said primer opening;

(c) a propellant superimposed with respect to said primer within said casing;

(d) an obturator wad element superimposed upon and covering said propellant;

(e) a sleeve member of constant diameter and substantially uniform wall thickness disposed within said casing in superimposed relation to said wad element;

(f) said sleeve member having interior diameter greater than twoce but less than 2.154 times the diameter of 00 lead buckshot and having exterior diameter only slightly less than but substantially equal to the interior diameter of said casing;

(g) a plurality of single pairs of pellets of 00 lead buckshot superimposed upon and in contact with each other within said sleeve member and each pair being disposed in a nesting zone with each adjacent pair, the centers of the pellets of each of said pairs being disposed between the transverse nesting zones of said pairs; and (h) closure means closing the end of said casing and holding said buckshot in said layers within said casing until the shotshell is fired.

19. A 12 Gauge 00 lead buckshot shotshell comprising:

(a) a plastic shotshell casing having elongated tubular sidewalls and having an integral, biaxially oriented, homogenous basewad with a centrally disposed primer opening extending axially therethrough;

(b) a shotshell primer disposed within said primer opening;

(c) a propellant superimposed with respect to said primer within said casing;

(d) obturator wad means superimposed upon and covering said propellant;

(e) a sleeve member disposed within said casing in superimposed relation to said wad means and having a constant internal diameter within the range of 2.000–2.154 times the diameter of 00 lead buckshot;

(f) a plurality of single pairs of 00 lead buckshot pellets superimposed upon and in contact with each other within said sleeve member, each of said pairs intersecting a transverse nesting zone with each adjacent single pair of said pellets, said pellets being arranged along a pair of separate varying helical paths about the axis of said casing;

(g) closure means closing the end of said casing and holding said buckshot in said layers within said casing until the shotshell is fired; and (h) the center of each of said pellets being located outside the nesting zones of said pellet and at least some of said pellets being located in offset transverse planes normal to the axis of said casing relative to other said pellets.

20. A 12 Gauge 00 lead buckshot shotshell comprising:

(a) a plastic shotshell casing having elongated tubular sidewalls and an integral, biaxially oriented, homogenous basewad approximately 0.090 inches in axial dimensions with a centrally disposed primer opening extending axially therethrough;

(b) a shotshell primer disposed within said primer opening;

(c) a propellant superimposed with respect to said primer within said casing;

(d) a shotcup disposed within said casing in superimposed relation to said propellant and having a constant internal diameter greater than but less than 2.000 times the diameter of 00 lead buckshot;

(e) a plurality of single pairs of 00 lead buckshot pellets stacked within said shotcup in superimposed relation and in contact with each other, each of said pairs intersecting a transverse nesting zone with each adjacent single pair of said pellets, said pellets being arranged along a pair of separate varying helical paths about the axis of said casing; and (f) closure means closing the end of said casing and holding said buckshot in said layers within said casing until the shotshell is fired, the center of each of said pellets being located outside the nesting zones of said pellet.

21. A method of producing a 00 lead buckshot shotshell of improved accuracy consisting in:

(a) providing an elongated plastic shotshell casing having a low, integral, biaxially-oriented, homogenous basewad approximating 0.090 inches in axial dimensions and having a centrally disposed primer opening extending axially through its basewad with a primer cup and primer disposed therein;

(b) placing a propellant within the casing in superimposed relation with the primer;

(c) providing a shotcup having constant interior diametric dimensions greater than twice but less than 2.154 times the diameter of one of the pellets to be contained therein and exterior dimensions slightly less than and substantially equal to the interior dimensions of the casing and having an annular sealing flange extending rearwardly from its bottom end;

(d) inserting that shotcup into the casing in superimposed relation to the propellant;

(e) stacking pairs of pellets of 00 lead buckshot in contact with each other in transverse nesting zones within the shotcup with less than four such pellets being in each such zone and none of the centers of such pellets other than the two innermost ones adjacent the bottom end of said shotcup being in the same plane normal to the axis of the shotshell; and (f) closing the end of the shotshell over the outermost layer of the pellets within the shotcup to hold the same therewithin until the shotshell is fired.

22. A method of producing a 00 lead buckshot shotshell of improved accuracy consisting in:

(a) providing an elongated plastic shotshell casing having a low, integral, biaxially-oriented, homogenous basewad having a centrally disposed primer opening extending axially therethrough with a primer cup and primer disposed therein;

(b) placing a propellant within the casing in superimposed relation with the primer;

(c) inserting an obturator wad within the casing in superimposed relation to the propellant;

(d) providing a sleeve member having interior diametric dimensions greater than but less than 2.0 times the diameter of one of the pellets to be contained therein and exterior dimensions substantially equal to the interior dimensions of the casing;

(e) inserting that sleeve member into the casing in superimposed relation to the propellant and obturator wad;

(f) stacking pellets of 00 lead buckshot in contact with each other in transverse nesting zones within the sleeve member, the center of each said pellet being located on different transverse planes normal to the axis of said casing; and (g) closing the end of the shotshell over the outermost layer of the pellets within the sleeve member to hold the same therewithin until the shotshell is fired.

* * * * *

UNITED STATES PATENT AND TRADEMARK OFFICE

CERTIFICATE OF CORRECTION

PATENT NO. : 4,679,505

DATED : July 14, 1987

INVENTOR(S) : Hugh B. Reed

It is certified that error appears in the above-identified patent and that said Letters Patent is hereby corrected as shown below:

Column 1, line 64, change "layers" to layer--.

Column 2, line 59, cancel "load" and substitute therefor --lead--.

Column 9, line 54, cancel "greater than but" and insert therefor --of--.

line 55, cancel "of" and insert therefor --greater than 2.0 but--.

Column 10, line 58, change "twoce" to --twice--.

Signed and Sealed this

Nineteenth Day of April, 1988

*Attest:*

DONALD J. QUIGG

*Attesting Officer*

*Commissioner of Patents and Trademarks*